US009139782B2

(12) United States Patent
Dindi et al.

(10) Patent No.: US 9,139,782 B2
(45) **Date of Patent: *Sep. 22, 2015**

(54) TARGETED PRETREATMENT AND SELECTIVE RING OPENING IN LIQUID-FULL REACTORS

(75) Inventors: Hasan Dindi, Wilmington, DE (US); Luis Eduardo Murillo, Wilmington, DE (US); Alan Howard Pulley, Lee's Summit, MO (US)

(73) Assignee: E I DU PONT DE NEMOURS AND COMPANY, Wilmington, DE (US)

( * ) Notice: Subject to any disclaimer, the term of this patent is extended or adjusted under 35 U.S.C. 154(b) by 373 days.

This patent is subject to a terminal disclaimer.

(21) Appl. No.: 13/025,427

(22) Filed: Feb. 11, 2011

(65) Prior Publication Data

US 2012/0205285 A1 Aug. 16, 2012

(51) Int. Cl.

*C10G 65/02* (2006.01)
*C10G 65/12* (2006.01)
*C10G 45/08* (2006.01)
(Continued)

(52) U.S. Cl.

CPC ..... *C10G 65/12* (2013.01); *C10G 45/08* (2013.01); *C10G 45/22* (2013.01); *C10G 45/48* (2013.01); *C10G 45/58* (2013.01); *C10G 45/60* (2013.01); *C10G 65/08* (2013.01); *C10G 69/02* (2013.01); *C10G 2300/4018* (2013.01);
(Continued)

(58) Field of Classification Search

CPC ..... C10G 45/00; C10G 45/02; C10G 45/06; C10G 45/08; C10G 45/22; C10G 45/44; C10G 45/46; C10G 45/48; C10G 45/50; C10G 65/00; C10G 65/02; C10G 65/04; C10G 65/043; C10G 65/08; C10G 65/12; C10G 2300/4081; C10G 45/60; C10G 2300/202; C10G 2300/307; C10G 2300/308; C10G 2300/4018; C10G 2300/802; C10G 2400/04

USPC ..... 208/49, 100, 56, 57, 58, 145, 208 R, 208/209, 210, 212, 213, 214, 251 H, 254 H

See application file for complete search history.

(56) References Cited

U.S. PATENT DOCUMENTS 3,554,898 A 1/1971 Wood et al.
3,657,112 A 4/1972 Franz et al.
(Continued)

FOREIGN PATENT DOCUMENTS

CA 899036 A 5/1972
CN 101280217 A 10/2008
(Continued)

OTHER PUBLICATIONS

Parkash, Surinder, Refining Processes Handbook, Chapter Two—Distillate Hydrotreating, 2003, p. 48, Elsevier Inc.
(Continued)

*Primary Examiner* — Prem C Singh
*Assistant Examiner* — Brandi M Doyle

(57) ABSTRACT

A process for hydroprocessing hydrocarbons in a combined targeted pretreatment and selective ring-opening unit wherein the targeted pretreatment comprises at least two stages in a single liquid recycle loop. The process operates as a liquid-full process, wherein all of the hydrogen dissolves in the liquid phase. Heavy hydrocarbons and light cycle oils can be converted in the process to provide a liquid product having over 50% in the diesel boiling range, with properties to meet use in low sulfur diesel.

26 Claims, 1 Drawing Sheet

(51) Int. Cl.

| | |
|---|---|
| ***C10G 45/22*** | (2006.01) |
| ***C10G 45/48*** | (2006.01) |
| ***C10G 45/58*** | (2006.01) |
| ***C10G 45/60*** | (2006.01) |
| ***C10G 65/08*** | (2006.01) |
| ***C10G 69/02*** | (2006.01) |

(52) U.S. Cl.
CPC . *C10G 2300/4081* (2013.01); *C10G 2300/802* (2013.01); *C10G 2400/04* (2013.01)

(56) References Cited

U.S. PATENT DOCUMENTS

| | | | | |
|---|---|---|---|---|
| 3,691,060 | A | 9/1972 | Inwood | |
| 3,761,395 | A | 9/1973 | Child et al. | |
| 5,298,152 | A | 3/1994 | Kramer | |
| 6,123,835 | A | 9/2000 | Ackerson et al. | |
| 6,413,142 | B1 * | 7/2002 | Weastler | 446/320 |
| 6,413,412 | B1 * | 7/2002 | Peng et al. | 208/89 |
| 6,428,686 | B1 | 8/2002 | Ackerson et al. | |
| 6,709,571 | B1 | 3/2004 | Del Rossi et al. | |
| 6,783,660 | B2 | 8/2004 | Dahlberg et al. | |
| 6,881,326 | B2 | 4/2005 | Ackerson et al. | |
| 7,214,309 | B2 | 5/2007 | Chen et al. | |
| 7,291,257 | B2 | 11/2007 | Ackerson et al. | |
| 7,431,824 | B2 | 10/2008 | Chen et al. | |
| 7,569,136 | B2 | 8/2009 | Ackerson et al. | |
| 7,615,142 | B2 | 11/2009 | Lee et al. | |
| 7,794,585 | B2 | 9/2010 | Leonard et al. | |
| 8,008,534 | B2 | 8/2011 | Petri et al. | |
| 2005/0006283 | A1 * | 1/2005 | Leung et al. | 208/213 |
| 2006/0144756 | A1 * | 7/2006 | Ackerson et al. | 208/108 |
| 2009/0095651 | A1 * | 4/2009 | Leonard et al. | 208/49 |
| 2009/0200202 | A1 * | 8/2009 | Grande et al. | 208/100 |
| 2009/0288986 | A1 * | 11/2009 | Colyar et al. | 208/58 |
| 2009/0321319 | A1 | 12/2009 | Kokayeff et al. | |
| 2009/0326289 | A1 * | 12/2009 | Petri et al. | 585/263 |
| 2010/0329942 | A1 | 12/2010 | Petri et al. | |

FOREIGN PATENT DOCUMENTS

| | | | |
|---|---|---|---|
| CN | 101280219 | A | 10/2008 |
| CN | 101358146 | A | 2/2009 |
| EP | 1394237 | A1 | 3/2004 |
| FR | 2895280 | A1 | 6/2007 |
| GB | 1232173 | A | 5/1971 |

OTHER PUBLICATIONS

Thakkar, Vasant P., et al., LCO Upgrading, A Novel Approach for Greater Added Value and Improved Returns, 2005, pp. 1-15, UOP LLC, Des Plaines, IL.

PCT International Search Report and Written Opinion dated Aug. 22, 2012.

* cited by examiner

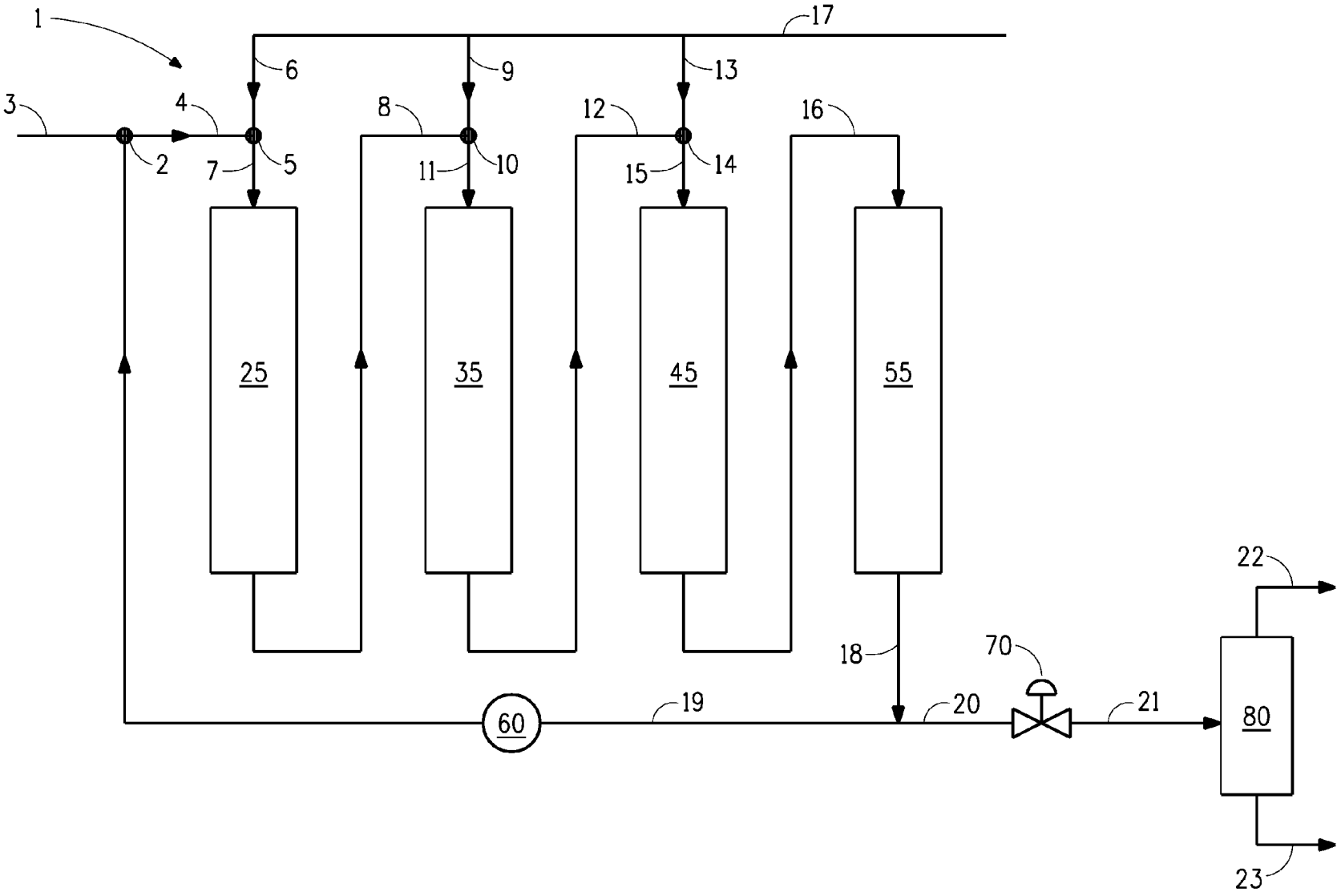
1
2
3
4
5
6
7
8
9
10
11
12
13
14
15
16
17
18
19
20
21
22
23
25
35
45
55
60
70
80

TARGETED PRETREATMENT AND SELECTIVE RING OPENING IN LIQUID-FULL REACTORS

FIELD OF THE INVENTION

The present invention relates to a process for hydroprocessing hydrocarbon feeds in liquid-full reactors with a single liquid recycle loop.

BACKGROUND OF THE INVENTION

Global demand for diesel, particularly for ultra-low-sulfur-diesel (ULSD) has risen quickly with increased growth of transportation fuels and a decrease in the use of fuel oil. Regulations for transportation fuels have been established to substantially lower the sulfur levels in diesel fuels. There are other pending rules calling to reduce the sulfur content in off-road diesel as well. Thus, there is a growing need for hydrocarbon feeds to use as feedstocks for producing diesel, including ULSD.

A refinery produces a number of hydrocarbon products having different uses and different values. It is desired to reduce production of or upgrade lower value products to higher value products. Two examples of lower value products are cycle oils and heavy hydrocarbons.

Cycle oils have historically been used as blend-stock into fuel oil. However, such oils cannot be directly blended into today's diesel fuels because of their high sulfur content, high nitrogen content, high aromatics content (particularly high polyaromatics), high density, and low cetane value.

Heavy hydrocarbon feeds contain compounds with high boiling points, and are generally characterized as having high asphaltene content, high viscosity and high density. Today, producers of heavy hydrocarbon mixtures have few options for their use, and the options available have relatively low commercial value.

Both cycle oils and heavy hydrocarbons have been used in heating oils. However, the sulfur contents of these hydrocarbons may limit their use due to recent regulations calling for more stringent heating oil sulfur standards.

Hydroprocessing, such as hydrodesulfurization and hydrodenitrogenation, have been used to remove sulfur and nitrogen, respectively from hydrocarbon feeds. An alternative hydroprocessing operation is hydrocracking, which has been used to crack heavy hydrocarbons (high density) into lighter products (lower density) with hydrogen addition. If the nitrogen content is too high in the hydrocarbon mixture going into the hydrocracking process, the zeolitic hydrocracking catalyst may be poisoned. In addition, if the hydrocracking is too severe, significant amounts of naphtha and lighter hydrocarbons, which are considered as lower value products, may be produced.

Conventional three-phase hydroprocessing units used for hydrotreating and high pressure hydrocracking, commonly known as trickle bed reactors, require hydrogen from a vapor phase to be transferred into liquid phase where it is available to react with a hydrocarbon feed at the surface of the catalyst. These units are expensive, require large quantities of hydrogen, much of which must be recycled through expensive hydrogen compressors, and result in significant coke formation on the catalyst surface and catalyst deactivation.

Alternative hydroprocessing approaches include hydrotreating and hydrocracking in a once-through flow scheme as proposed by Thakkar et al. in "LCO Upgrading A Novel Approach for Greater Value and Improved Returns" AM, 05-53, NPRA, (2005). Thakkar et al. disclose upgrading a light cycle oil (LCO) into a mixture of liquefied petroleum gas (LPG), gasoline and diesel products. Thakkar et al. disclose producing a low sulfur content diesel (ULSD) product. However, Thakkar et al. use traditional trickle bed reactors, which require large quantities of hydrogen and large process equipment such as a large gas compressor for hydrogen gas circulation. Significant amounts of light gas and naphtha are produced in the disclosed hydrocracking process. The diesel product accounts for only about 50%, or less, of the total liquid product using LCO feed.

Kokayeff, in U.S. Pat. No. 7,794,585, discloses a process for hydrotreating and hydrocracking hydrocarbon feedstocks in a "substantially liquid phase", which is defined as the feed stream has a larger liquid phase than a gas phase. More specifically, hydrogen may be present in a gas phase up to 1000 percent of saturation. Kokayeff teaches such high amounts are needed so that as hydrogen is consumed, hydrogen is available from the gas phase. Thus, Kokayeff's reaction system is a trickle bed. Separation of gases occurs after hydrocracking and before recycling a portion of the liquid product. Thus, hydrogen gas is lost from the reactor effluent, which may be significant, as Kokayeff teaches adding hydrogen well above the hydrogen saturation limit of the liquid.

It is desirable to have a process for hydroprocessing hydrocarbon feeds in a smaller and simpler system without an added gas phase or gas separation that may result in loss of process hydrogen. It is also desirable to have a process for hydroprocessing hydrocarbon feeds to produce low sulfur diesel in good yield and achieving multiple desirable diesel properties such as low density and low poly-aromatic content and high cetane number. It is further desired to have a process to upgrade lower value refinery hydrocarbons to higher value products.

SUMMARY OF THE INVENTION

The present invention provides a process for hydroprocessing a hydrocarbon feed, which comprises (a) contacting the feed with (i) a diluent and (ii) hydrogen, to produce a feed/diluent/hydrogen mixture, wherein the hydrogen is dissolved in the mixture to provide a liquid feed; (b) contacting the feed/diluent/hydrogen mixture with a first catalyst in a first treatment zone, referred to herein as a "targeted pretreatment" zone, to produce a first product effluent; (c) contacting the first product effluent with a second catalyst in a second treatment zone, referred to herein as a "selective ring-opening" zone, to produce a second product effluent; and (d) recycling a portion of the second product effluent as a recycle product stream for use in the diluent in step (a)(i) at a recycle ratio of from about 1 to about 8, wherein the first treatment zone comprises at least two stages, the first and second treatment zones are liquid-full reaction zones, and the total amount of hydrogen fed to the process is greater than 100 normal liters of hydrogen per liter of feed.

The process of this invention operates as a liquid-full process and the first and second treatment zones are liquid-full reaction zones. By "liquid-full process", it is meant herein that all of the hydrogen present in the process can be dissolved in the liquid. By "liquid-full reaction zone", it is meant no gas phase hydrogen is present in the contacting zone (catalyst bed) of the feed/diluent/hydrogen mixture with the first catalyst and the second product effluent with the second catalyst.

The catalysts in the targeted pretreatment and the selective ring-opening zones each comprise a metal and an oxide support. The metal is a non-precious metal selected from the group consisting of nickel and cobalt, and combinations thereof, preferably combined with molybdenum and/or tungsten. The first catalyst support is a mono- or mixed-metal oxide, preferably selected from the group consisting of alumina, silica, titania, zirconia, kieselguhr, silica-alumina and combinations of two or more thereof. The second catalyst support is a zeolite, amorphous silica, or a combination thereof.

In the first treatment zone, a hydrocarbon feed undergoes targeted pretreatment to reduce its nitrogen, sulfur and aromatics. The reduction of the nitrogen content of the feed in the targeted pretreatment zone is critical in order to prevent poisoning of the second catalyst in the second treatment zone. In the second treatment zone, the effluent from the first treatment zone undergoes a selective or enhanced ring opening to improve its cetane value and to reduce its density (volume swell).

BRIEF DESCRIPTION OF THE FIGURE

FIG. 1 is a flow diagram illustrating one embodiment of the targeted pretreatment/selective ring opening process of this invention.

DETAILED DESCRIPTION

The present invention provides a process for hydroprocessing a hydrocarbon feed, which comprises (a) contacting the feed with (i) a diluent and (ii) hydrogen to produce a feed/diluent/hydrogen mixture, wherein the hydrogen is dissolved in the mixture to provide a liquid feed; (b) contacting the feed/diluent/hydrogen mixture with a first catalyst in a first treatment zone, to produce a first product effluent; (c) contacting the first product effluent with a second catalyst in a second treatment zone, to produce a second product effluent; and (d) recycling a portion of the second product effluent as a recycle product stream for use in the diluent in step (a)(i) at a recycle ratio of from about 1 to about 8, wherein the first treatment zone comprises at least two stages, the first and second treatment zones are liquid-full reaction zones, and the total amount of hydrogen fed to the process is greater than 100 normal liters of hydrogen per liter of feed.

Hydrocarbon feeds suitable for use in the present invention include a hydrocarbon feed having a density of at least 0.910 g/ml at a temperature of 15.6° C., and an end boiling point in the range of from about 375° C. to about 650° C. A suitable feed has an API gravity in the range from about 24 to about 0. The feed may have high levels of one or more contaminants such as sulfur, nitrogen and metals. For example, the feed may have a sulfur content in the range from 1500 to 25000 parts per million by weight (wppm), and/or a nitrogen content of more than 500 wppm.

In one embodiment, the hydrocarbon feed is a "heavy hydrocarbon feed", which as used herein, means a feed comprising one or more hydrocarbons, having an asphaltenes content of at least 3%, based on the total weight of the feed, Conradson carbon content in the range of from about 0.25% to about 8.0% by weight, a viscosity of at least 5 cP, and an end boiling point in the range of from about 410° C. to about 650° C. The asphaltenes content of heavy hydrocarbons generally varies from about 3% to about 15%, and can be as high as 25%, based on the total weight of the feed.

In one embodiment of the invention, light cycle oil is used as the feed to produce low sulfur diesel. Light cycle oil has a cetane index in the range from about 15 to about 26. Light cycle oil also has polyaromatics content in the range from about 40% to about 50% by weight, and monoaromatics content in the range from about 20% to about 40% by weight, and the total aromatics content in the range from about 60% to about 90% by weight. Light cycle oil has a density of at least 0.930 g/ml at a temperature of 15.6° C.

Surprisingly, the process of the present invention can lower the density of the diesel product to about 0.860 g/ml or less at a temperature of 15.6° C., and achieve desirable diesel properties, including sulfur content of less than 50 wppm, preferably less than 10 wppm, and increased cetane index by at least 12 points relative to the hydrocarbon feed. Preferably the cetane index is at least 27, can be from 27 to 42, and may be even higher. Other desirable properties of the diesel product include a minimum freeze point of −10° C. and a minimum flash point of 62° C. Diesel product is produced by distilling the total liquid product (after gases have been removed) and removing the naphtha product (fraction of total liquid product having a maximum boiling point of 200° C.).

Heavy hydrocarbons and light cycle oils are a couple of examples of hydrocarbon feeds suitable for use in the process of this invention. Such feeds are available, such as from refineries, for upgrading by the liquid-full targeted pretreatment/selective ring opening process of the present invention. These and other hydrocarbon feeds useful in the present invention are known to those skilled in the art.

The diluent comprises, consists essentially of, or consists of recycled product stream. Recycle product stream is a portion of the product mixture—second product effluent—that is recycled and combined with the hydrocarbon feed before or after contacting the feed with hydrogen, preferably before contacting the feed with hydrogen. The recycle product stream provides at least a portion of the diluent at a recycle ratio in a range of from about 1 to about 8, preferably at a recycle ratio of from about 1 to about 5.

In addition to recycle product stream, the diluent may comprise any other organic liquid that is compatible with the heavy hydrocarbon feed and catalysts. When the diluent comprises an organic liquid in addition to the recycled product stream, preferably the organic liquid is a liquid in which hydrogen has a relatively high solubility. The diluent may comprise an organic liquid selected from the group consisting of light hydrocarbons, light distillates, naphtha, diesel and combinations of two or more thereof. More particularly, the organic liquid is selected from the group consisting of propane, butane, pentane, hexane or combinations thereof. When the diluent comprises an organic liquid, the organic liquid is typically present in an amount of no greater than 90%, based on the total weight of the feed and diluent, preferably 20-85%, and more preferably 50-80%. Most preferably, the diluent consists of recycled product stream, including dissolved light hydrocarbons.

In the first step of the process of the present invention, a feed is contacted with a diluent and hydrogen. The feed can be contacted first with hydrogen and then with the diluent, or preferably, first with the diluent and then with hydrogen to produce a feed/diluent/hydrogen mixture. The feed/diluent/hydrogen mixture is contacted with a first catalyst first in a first treatment zone to produce a first product effluent.

The first treatment zone is a targeted pretreatment. By "targeted pretreatment" it is meant herein a hydrotreating process wherein a specific target on sulfur, nitrogen, aromatics and/or metal content in the product is met by catalyst selection and/or controlling one or more of the reaction conditions (e.g., temperature, pressure, space velocity, etc.). More particularly, targeted pretreatment provides a first product effluent, which after the second treatment zone and separation steps, the diesel product has specifications for a sulfur content less than 50 wppm, nitrogen content less than 10 wppm, aromatics: polyaromatics content of less than 10 wt. % and total aromatics content of less than 40 wt. %, and heavy metal content of less than 1 wppm. Separation steps include removing gases from the second product effluent and distilling to remove the naphtha product.

The targeted pretreatment process may include one or more of the following based on the hydrocarbon feed: hydrodesulfurization, hydrodenitrogenation, hydrodemetallation, hydrodeoxygenation, and hydrogenation, depending on the feed, in multiple reaction stages with a single liquid recycle loop. By "single recycle loop" is meant herein, a portion (based on the selected recycle ratio) of the second product effluent is recirculated from the outlet of the second treatment zone to the inlet of the first treatment zone. Thus, all catalyst beds in the process are included in the one recycle loop. There is no separate recycle for just the first treatment zone or just the second treatment zone.

The first treatment zone comprises at least two stages. By "at least two stages" it is meant herein two or more (multiple) catalyst beds in series. Catalyst is charged to each bed. A single stage may be one reactor containing one catalyst bed. The first treatment zone may comprise at least two reactors each reactor containing one catalyst bed, wherein the reactors are in liquid communication, e.g., through an effluent line. The first treatment zone may comprise at least two catalyst beds in one reactor, e.g., a column reactor. Other variations, including those having more than two stages can be readily appreciated and understood by one skilled in the art. In a column reactor or other single vessel containing two or more catalyst beds or between multiple reactors, the beds are physically separated by a catalyst-free zone. Preferably hydrogen can be fed between the beds to increase hydrogen content in the product effluent between the stages. Hydrogen dissolves in the liquid effluent in the catalyst-free zone so that the catalyst bed is a liquid-full reaction zone. Thus, fresh hydrogen can be added into the liquid feed/diluent/hydrogen mixture or effluent from a previous reactor (in series) at the catalyst-free zone, where the fresh hydrogen dissolves in the mixture or effluent prior to contact with the catalyst bed. A catalyst-free zone in advance of a catalyst bed is illustrated, for example, in U.S. Pat. No. 7,569,136.

The second treatment zone comprises one or more stages, where "stages" is defined in the previous paragraph. The second treatment zone provides "selective" or "enhanced" ring manipulation of aromatic compounds. By selective or enhanced ring manipulation, it is meant increased ring opening activity relative to hydrogenating polyaromatics to monoaromatics or to saturated ring compounds or partially or completely opening the saturated rings into linear or branched hydrocarbons. Selectivity and degree of such ring manipulation is a surprising improvement relative to the process disclosed by Thakkar et al. in the NPRA article vide supra, page 8, line 9.

A column reactor may comprise both the first treatment zone and the second treatment zone. Such reactor contains at least two stages (catalyst beds) for the first treatment zone and one or more stages for the second treatment zone. Between each stage, there is a catalyst-free zone that can be used, for example to add and dissolve fresh hydrogen into the liquid effluent.

Both targeted pretreatment and enhanced ring manipulation of aromatic compounds with increased ring opening activity contributes to high hydrogen demand and consumption. In the first and second treatment zones, the total amount of hydrogen fed to the process is greater than 100 normal liters of hydrogen per liter of feed (N l/l) or greater than 560 scf/bbl. Preferably, the total amount of hydrogen fed to the process is 200-530 N l/l (1125-3000 scf/bbl), more preferably 250-360 N l/l (1400-2000 scf/bbl). The combination of feed and diluent is capable of providing all of the hydrogen in the liquid phase, without need for gas phase for such high consumption of hydrogen. That is, the treatment zones are liquid-full reaction zones.

The process of the present invention can operate under a wide variety of conditions, from mild to extreme. Temperature for both the first treatment zone and the second treatment zone range from about 300° C. to about 450° C., preferably from about 300° C. to about 400° C., and more preferably from about 350° C. to 400° C. Pressure for both the first treatment zone and the second treatment zone range from about 3.45 MPa (34.5 bar) to 17.3 MPa (173 bar), preferably from about 6.9 to 13.9 MPa (69 to 138 bar).

A wide range of suitable catalyst concentrations may be used in the first and second treatment zones. Preferably, the catalyst is about 10 to about 50 wt % of the reactor contents for each reaction zone. The hydrocarbon feed is fed to the first treatment zone at a rate to provide a liquid hourly space velocity (LHSV) of from about 0.1 to about 10 $hr^{-1}$, preferably, about 0.4 to about 10 $hr^{-1}$, more preferably about 0.4 to about 4.0 $hr^{-1}$.

The liquid product produced by the process of the present invention can be separated into a naphtha product and a diesel product wherein the diesel product meets criteria for blending into low sulfur middle distillate fuels such as low sulfur diesel. The liquid product comprises less than 50% by weight of total product boiling in the naphtha range (naphtha product) and correspondingly at least 50% of the product boils in the diesel range (diesel product), preferably less than 25% by weight of total product is naphtha product and at least 75% of the product is diesel product.

In conventional processes, ring opening is separated from pretreatment as two distinct processes due to poisoning effect of sulfur and nitrogen compounds on ring opening catalysts. Thus, such processes require a separation step to remove hydrogen sulfide and ammonia, especially ammonia, from a hydrotreated product. In an alternative process, gas is separated from product effluent before effluent is recycled. Both such separations are undesirable as they may cause loss of hydrogen from the product effluent. In the present invention, hydrogen is recycled with the recycled product stream, without loss of gas phase hydrogen.

In the pretreatment zone of the present invention, organic nitrogen and organic sulfur are converted to ammonia (hydrodenitrogenation) and hydrogen sulfide (hydrodesulfurization), respectively. There is no separation of ammonia and hydrogen sulfide and remaining hydrogen from the effluent of the pretreatment zone (first product effluent) prior to feeding the effluent to the second (ring opening) zone. The resulting ammonia and hydrogen sulfide after the pretreatment step are dissolved in the liquid first product effluent. In addition, the recycled product stream is combined with fresh feed without separating ammonia and hydrogen sulfide and remaining hydrogen from the second product effluent. Still, the first and second catalysts do not exhibit deactivation or coking on the catalyst surface.

The process of this invention also operates as a liquid-full process. By "liquid-full process", it is meant herein that all of the hydrogen present in the process can be dissolved in the liquid. A "liquid-full reactor" is a reactor in which all of the hydrogen is dissolved in the liquid phase when the liquid phase is in contact with the catalyst bed. There is no gas phase. The reactors in both the first and second treatment zones are liquid-full reactors.

The reactors in both the first and second treatment zones are two-phase systems wherein the first and second catalysts are solid phase and the reactants (feed, diluent, hydrogen) and product effluents are all in the liquid phase. Each reactor is a fixed bed reactor and may be of a plug flow, tubular or other design, which is packed with a solid catalyst (i.e., a packed bed reactor) and wherein the liquid feed/diluent/hydrogen mixture is passed through the catalyst.

Surprisingly, the process of the present invention eliminates or minimizes catalyst coking which is one of the biggest problems with conventional hydrocarbon feeds as defined herein. Since high hydrogen uptake in hydrotreating heavy feeds (e.g., 100-530 l/l, 560-3000 scf/bbl) results in high heat generation in the reactor, severe cracking was expected to occur on the surface of the catalyst. If the amount of hydrogen available is not sufficient, the cracking can lead to coke formation and deactivate the catalyst. The process of the present invention makes all of the hydrogen required for reaction available in the liquid feed/diluent/hydrogen mixture, thus eliminating the need to circulate hydrogen gas within the reactor. Since there is enough hydrogen available in solution and available at the catalyst surface, coking of the catalyst is largely avoided. In addition, the liquid-full reactors of the present invention dissipate heat much better than conventional trickle bed reactors, also contributing to long catalyst life.

The first catalyst is a hydrotreating catalyst and comprises a metal and an oxide support. The metal is a non-precious metal selected from the group consisting of nickel and cobalt, and combinations thereof, preferably combined with molybdenum and/or tungsten. The first catalyst support is a mono- or mixed-metal oxide, preferably selected from the group consisting of alumina, silica, titania, zirconia, kieselguhr, silica-alumina and combinations of two or more thereof. More preferably, the first catalyst support is alumina.

The second catalyst is a ring opening catalyst and also comprises a metal and an oxide support. The metal is also a non-precious metal selected from the group consisting of nickel and cobalt, and combinations thereof, preferably combined with molybdenum and/or tungsten. The second catalyst support is a zeolite, or amorphous silica, or a combination thereof.

Preferably the metal for both the first catalyst and the second catalyst is a combination of metals selected from the group consisting of nickel-molybdenum (NiMo), cobalt-molybdenum (CoMo), nickel-tungsten (NiW) and cobalt-tungsten (CoW).

The first and second catalysts may further comprise other materials including carbon, such as activated charcoal, graphite, and fibril nanotube carbon, as well as calcium carbonate, calcium silicate and barium sulfate.

Preferably, the first catalyst and the second catalyst are in the form of particles, more preferably shaped particles. By "shaped particle" it is meant the catalyst is in the form of an extrudate. Extrudates include cylinders, pellets, or spheres. Cylinder shapes may have hollow interiors with one or more reinforcing ribs. Trilobe, cloverleaf, rectangular- and triangular-shaped tubes, cross, and "C"-shaped catalysts can be used. Preferably a shaped catalyst particle is about 0.25 to about 13 mm (about 0.01 to about 0.5 inch) in diameter when a packed bed reactor is used. More preferably, a catalyst particle is about 0.79 to about 6.4 mm (about 1/32 to about 1/4 inch) in diameter. Such catalysts are commercially available.

The catalysts may be sulfided before and/or during use by contacting the catalyst with a sulfur-containing compound at an elevated temperature. Suitable sulfur-containing compound include thiols, sulfides, disulfides, $H_2S$, or combinations of two or more thereof. The catalyst may be sulfided before use ("pre-sulfiding") or during the process ("sulfiding") by introducing a small amount of a sulfur-containing compound in the feed or diluent. The catalysts may be pre-sulfided in situ or ex situ and the feed or diluent may be supplemented periodically with added sulfur-containing compound to maintain the catalysts in sulfided condition. The Examples provide a pre-sulfiding procedure.

DESCRIPTION OF THE FIGURE

FIG. 1 provides an illustration for one embodiment of the hydrocarbon conversion process of this invention. Certain detailed features of the proposed process, such as pumps and compressors, separation equipment, feed tanks, heat exchangers, product recovery vessels and other ancillary process equipment are not shown for the sake of simplicity and in order to demonstrate the main features of the process. Such ancillary features will be appreciated by one skilled in the art. It is further appreciated that such ancillary and secondary equipment can be easily designed and used by one skilled in the art without any difficulty or any undue experimentation or invention.

FIG. 1 illustrates an integrated exemplary hydrocarbon processing unit 1. Fresh hydrocarbon feed, such a light cycle oil or a heavy oil, is introduced via line 3 and combined with a portion of the effluent of bed 55 (bed 4) via line 19 at mixing point 2. The portion of the effluent in line 19 is pumped through pump 60 to mixing point 2 to provide combined liquid feed 4. A hydrogen gas stream is mixed with combined liquid feed 4 via line 6 at mixing point 5 to introduce sufficient hydrogen to saturate combined liquid feed 4. The resulting combined liquid feed/hydrogen mixture flows through line 7 into first pretreatment bed 25.

The main hydrogen head 17 is the source for hydrogen make-up to the first three beds (bed 25, bed 35 and bed 45).

The effluent from pretreatment bed 25, line 8 is mixed with additional fresh hydrogen gas fed via line 9 at mixing point 10 and the combined substantially liquid-stream flows via line 11 to second pretreatment bed 35. The pretreated effluent exits pretreatment bed 35 via line 12. Pretreated effluent in line 12 is combined with additional fresh hydrogen gas fed via line 13 at mixing point 14 to provide a liquid feed. The liquid feed from mixing point 14 is fed via line 15 to first ring opening bed 45. The effluent from first ring opening bed 45 is fed to second ring opening bed 55 via line 16. The effluent from the ring opening bed 55 is removed via line 18. A portion of the effluent from line 18 is returned to first pretreatment bed 25 via line 19 through pump 60 to mixing point 2. The ratio of fresh hydrocarbon feed fed via line 3 to effluent from line 19 is preferably between 1 and 8. Effluent from line 18 is sent via line 20 to control valve 70. From control valve 70, effluent is fed via line 21 to separator 80. Gas products are removed via line 22. Total liquid product is removed via line 23. Product from line 23 may be fractioned (distilled) elsewhere to separate a smaller naphtha (gasoline) blending stock from a substantially larger amount of a diesel blending stock.

The liquid flow (feed, diluent, including recycle product stream, and hydrogen) in FIG. 1 is illustrated as downflow through the reactors 25, 35, 45 and 55. It is preferred that the feed/diluent/hydrogen mixture and product effluents are fed to the reactors in a downflow mode. However, an upflow process is also contemplated herein.

EXAMPLES

Analytical Methods and Terms

ASTM Standards. All ASTM Standards are available from ASTM International, West Conshohocken, Pa., www.astm.org.

Amounts of sulfur, nitrogen and basic nitrogen are provided in parts per million by weight, wppm.

Total Sulfur was measured using ASTM D4294 (2008), "Standard Test Method for Sulfur in Petroleum and Petroleum Products by Energy Dispersive X-ray Fluorescence Spectrometry," DOI: 10.1520/D4294-08 and ASTM D7220 (2006), "Standard Test Method for Sulfur in Automotive Fuels by Polarization X-ray Fluorescence Spectrometry," DOI: 10.1520/D7220-06

Total Nitrogen was measured using ASTM D4629 (2007), "Standard Test Method for Trace Nitrogen in Liquid Petroleum Hydrocarbons by Syringe/Inlet Oxidative Combustion and Chemiluminescence Detection," DOI: 10.1520/D4629-07 and ASTM D5762 (2005), "Standard Test Method for Nitrogen in Petroleum and Petroleum Products by Boat-Inlet Chemiluminescence," DOI: 10.1520/D5762-05.

Aromatic content was determined using ASTM Standard D5186-03 (2009), "Standard Test Method for Determination of Aromatic Content and Polynuclear Aromatic Content of Diesel Fuels and Aviation Turbine Fuels by Supercritical Fluid Chromatography", DOI: 10.1520/D5186-03R09.

Boiling point distribution (Table 1) was determined using ASTM Standard D6352 (2004), "Standard Test Method for Boiling Range Distribution of Petroleum Distillates in Boiling Range from 174 to 700° C. by Gas Chromatography", DOI: 10.1520/D6352-04R09.

Boiling range distribution (Tables 4 and 7) was determined using ASTM D2887 (2008), "Standard Test Method for Boiling Range Distribution of Petroleum Fractions by Gas Chromatography," DOI: 10.1520/D2887-08.

Density, Specific Gravity and API Gravity were measured using ASTM Standard D4052 (2009), "Standard Test Method for Density, Relative Density, and API Gravity of Liquids by Digital Density Meter," DOI: 10.1520/D4052-09.

"API gravity" refers to American Petroleum Institute gravity, which is a measure of how heavy or light a petroleum liquid is compared to water. If API gravity of a petroleum liquid is greater than 10, it is lighter than water and floats; if less than 10, it is heavier than water and sinks. API gravity is thus an inverse measure of the relative density of a petroleum liquid and the density of water, and is used to compare relative densities of petroleum liquids.

The formula to obtain API gravity of petroleum liquids from specific gravity (SG) is:

$$\text{API gravity}=(141.5/SG)-131.5$$

Bromine Number is a measure of aliphatic unsaturation in petroleum samples. Bromine Number was determined using ASTM Standard D1159, 2007, "Standard Test Method for Bromine Numbers of Petroleum Distillates and Commercial Aliphatic Olefins by Electrometric Titration," DOI: 10.1520/D1159-07.

Cetane index is useful to estimate cetane number (measure of combustion quality of a diesel fuel) when a test engine is not available or if sample size is too small to determine this property directly. Cetane index was determined by ASTM Standard D4737 (2009a), "Standard Test Method for Calculated Cetane Index by Four Variable Equation," DOI: 10.1520/D4737-09a.

Cloud point is an index of the lowest temperature of the utility of a petroleum product for certain applications. Cloud point was determined by ASTM Standard D2500-09 "Standard Test Method for Cloud Point of Petroleum Products", DOI: 10.1520/D2500-09

"LHSV" means liquid hourly space velocity, which is the volumetric rate of the liquid feed divided by the volume of the catalyst, and is given in $hr^{-1}$.

Refractive Index (RI) was determined using ASTM Standard D1218 (2007), "Standard Test Method for Refractive Index and Refractive Dispersion of Hydrocarbon Liquids," DOI: 10.1520/D1218-02R07.

"WABT" means weighted average bed temperature.

The following examples are presented to illustrate specific embodiments of the present invention and not to be considered in any way as limiting the scope of the invention.

Examples 1-3

The properties of a gas oil (GO) from a commercial refiner are shown in Table 1. The GO was hydroprocessed in an experimental pilot unit containing four fixed bed reactors in series. Each reactor was of 19 mm (¾") OD 316 L stainless steel tubing and about 61 cm (24") in length with reducers to 6 mm (¼") on each end. Both ends of the reactors were first capped with metal mesh to prevent catalyst leakage. Below the metal mesh, the reactors were packed with layers of 1 mm glass beads at both ends. Catalyst was packed in the middle section of the reactor.

TABLE 1

Properties of Gas Oil used in Examples 1 and 2

| Property | Unit | Value |
|---|---|---|
| Sulfur | wppm | 19900 |
| Nitrogen | wppm | 935 |
| Density at 15.6° C. (60° F.) | g/ml | 0.9198 |
| API Gravity | | 22.2 |

Boiling Point Distribution

| % | ° C. |
|---|---|
| IBP | 249 |
| 5 | 328 |
| 10 | 356 |
| 20 | 386 |
| 30 | 407 |
| 40 | 425 |
| 50 | 442 |
| 60 | 461 |
| 70 | 481 |
| 80 | 504 |
| 90 | 533 |
| 95 | 554 |
| 99 | 583 |
| FBP | 591 |

IBP = Initial boiling point
FBP = Final boiling point

The first two reactors, Reactors 25 and 35, were used for targeted pretreatment ("PT"). Reactors 1 and 2 contained a hydrotreating catalyst for hydrodenitrogenation (HDN), hydrodesulfurization (HDS) and hydrodearomatization (HDA). About 48.6 ml and 90 ml of catalyst were loaded in the first and second reactors, respectively. The catalyst, KF-860, was a NiMo on $\gamma$-$Al_2O_3$ support from Albemarle Corp., Baton Rouge, La. It was in the form of extrudates of a quadralobe about 1.3 mm diameter and 10 mm long. Reactor 25 was packed with layers of 30 ml (bottom) and 25 ml (top) of glass beads, while Reactor 35 was packed with a layer of 10 ml (bottom) and 9 ml (top) of glass beads.

Reactors 45 and 55 were used for selective ring opening ("RO"). Reactors 45 and 55 were packed with layers of 1 mm glass beads at both ends, 10 ml at the bottom and 15 ml at the top, and contained 90 ml each of a selective ring opening catalyst. This catalyst, KC-2610, was a NiW catalyst on a zeolite support from Albemarle. It was in the form of extrudates of a cylindrical shape of about 1.5 mm diameter and 10 mm long.

Each reactor was placed in a temperature controlled sand bath in a 7.6 cm (3") OD and 120 cm long pipe filled with fine sand. Temperature was monitored at the inlet and outlet of each reactor as well as in each sand bath. The temperature in each reactor was controlled using heat tapes wrapped around the 3" OD pipe and connected to temperature controllers. After exiting Reactor 55, the effluent was split into a recycle stream and a product effluent. The liquid recycle stream flowed through a piston metering pump, to join a fresh hydrocarbon feed at the inlet of the first reactor.

Hydrogen was fed from compressed gas cylinders and the flow rates were measured using mass flow controllers. The hydrogen was injected and mixed with the combined fresh GO feed and the recycle product stream before Reactor 25. The combined "fresh GO/hydrogen/recycle product" stream flowed downwardly through a first temperature-controlled sand bath in a 6 mm OD tubing and then in an up-flow mode through Reactor 25. After exiting Reactor 25, additional hydrogen was injected in the effluent of Reactor 25 (feed to Reactor 35). The feed to Reactor 35 flowed downwardly through a second temperature-controlled sand bath in a 6 mm OD tubing and then in an up-flow mode through Reactor 35. After exiting Reactor 35, more hydrogen was dissolved in the effluent of Reactor 35 (feed to Reactor 45). The liquid feed to Reactors 45 and 55 followed the same pattern, with hydrogen gas injection before each reactor.

In Example 1, both the targeted pretreatment catalyst (total 138.6 ml) and the selective ring-opening catalyst (total 180 ml) were charged to the reactors as described above. They were dried overnight at 115° C. under a total flow of 300 standard cubic centimeters per minute (sccm) of hydrogen. The pressure was 6.9 MPa (69 bar). The catalyst-charged reactors were heated to 176° C. with a flow of charcoal lighter fluid through the catalyst beds. Sulfur spiking agent (1 wt % sulfur, added as 1-dodecanethiol) and hydrogen gas were introduced into the charcoal lighter fluid at 176° C. to start to pre-sulfide the catalysts. The pressure was 6.9 MPa (69 bar). The temperature in each reactor was increased gradually to 320° C. Pre-sulfiding was continued at 320° C. until a breakthrough of hydrogen sulfide ($H_2S$) at the outlet of Reactor 55. After pre-sulfiding, the catalysts were stabilized by flowing a straight run diesel (SRD) feed through the catalyst beds at a temperature from 320° C. to 355° C. and at 6.9° MPa (1000 psig or 69 bar) for 10 hours.

After pre-sulfiding and stabilizing the catalysts, fresh GO feed was pre-heated to 50° C., and was pumped to Reactor 25 using a syringe pump at a flow rate of 2.37 ml/minute for a targeted pre-treatment LHSV of 1.0 $hr^{-1}$. Total hydrogen feed rate was 180 normal liters per liter (N l/l) of fresh hydrocarbon feed (1000 scf/bbl). Reactors 25 and 35 had each a weighted average bed temperature or WABT of 382° C. Reactors 45 and 55 were each held under 204° C. to avoid initially any selective ring-opening reactions. Pressure was 10.8 MPa (108 bar). The recycle ratio was 5. The pilot unit was kept at these conditions for an additional 10 hours to assure that the catalyst was fully precoked and the system was lined-out while testing product samples for both total sulfur and total nitrogen. Results are provided in Table 2.

TABLE 2

Summary of Examples 1 to 3

| Example | TP LHSV $hr^{-1}$ | RO LHSV $hr^{-1}$ | WABT ° C. | RR | Density$^{15.6°\ C.}$ g/ml | Sulfur wppm | Nitrogen wppm | BP @(50%) (° C.) | $H_2$ Cons. N l/l (scf/bbl) |
|---|---|---|---|---|---|---|---|---|---|
| Feed | | | | | 0.9198 | 19900 | 935 | 442 | |
| 1 | 1 | 0 | 382 | 5 | 0.8433 | 29 | 2 | 308 | 109 (610) |
| 2 | 1 | 0 | 393 | 6.9 | 0.8397 | 45 | 11 | 364 | 123 (690) |
| 3 | 1 | 1.6 | 393 | 5 | 0.8153 | 25 | 10 | 299 | 160 (900) |

Abbreviations:

TP is targeted pretreatment for removing nitrogen, sulfur and aromatics.

RO is selective ring-opening to break larger hydrocarbon molecules into smaller hydrocarbon molecules.

RR is recycle ratio

BP@(50%) is the boiling point at 50% of the mixture as determined by ASTM D6352.

Tests in Examples 2 and 3 were conducted under similar conditions to those in Example 1. Example 2 was run at a WABT of 393° C. using Reactors 25 and 35 only at a recycle ratio of 6.9. Example 3 was run at a WABT of 393° C. using Reactors 25, 35, 45, and 55 (both PT and RO) at a recycle ratio of 5. Results are shown in Table 2.

A Total Liquid Product (TLP) sample and an off-gas sample were collected for each Example under the steady state conditions. The sulfur and nitrogen contents for the products of both Example 1 and Example 2, neither of which involved ring-opening, were sufficiently low to pose no risk of poisoning a zeolite-based ring-opening catalyst. Selective ring-opening conversion (based on the average boiling point) for Example 3 was about 32%. These results show that the combined targeted pretreatment and selective ring-opening process reduces the density of the feed much more than that using the targeted pre-treatment process only.

Examples 4-8

A 100% light cycle oil (LCO) from a FCC unit of a petroleum refinery having the properties set forth in Tables 3 and 4 was hydroprocessed in the pilot unit described in Example 1, with certain modifications.

TABLE 3

Properties of Light Cycle Oil used in Examples 4 to 8

| Property | Unit | Measured | Preferred Diesel Specs |
|---|---|---|---|
| Sulfur content | wppm | 4980 | <50 |
| Nitrogen content | wppm | 671 | <20 |
| Density at 15.6° C. | g/ml | 0.9409 | 0.860 |
| Density at 20° C. | g/ml | 0.9377 | |
| API Gravity | g/ml | 18.7 | |
| Refractive Index at 20° C. | | 1.544 | |
| Bromine Number | g/100 g | 5.0 | |
| Cetane Index | | 24.6 | Increase >+12 |
| Aromatic content | | | |
| Monoaromatics | wt % | 22.7 | |
| Polyaromatics | wt % | 45.6 | |
| Total Aromatics | wt % | 68.3 | |

TABLE 4

Boiling Point Distribution of LCO used in Examples 4 to 8

| Simulated distillation, wt % | Boiling Point ° C. (° F.) |
|---|---|
| Initial Boiling Point (IBP) | 104 (218) |
| 5% | 205 (401) |
| 10% | 237 (459) |
| 20% | 260 (500) |
| 30% | 269 (516) |
| 40% | 284 (544) |
| 50% | 297 (566) |
| 60% | 310 (589) |
| 70% | 329 (625) |
| 80% | 346 (655) |
| 90% | 362 (684) |
| 95% | 370 (699) |
| 99% | 394 (741) |
| End Point (EP) | 414 (778) |

Tables 3 and 4 show that, compared to a diesel sample, the LCO feed is higher boiling with a polyaromatic content of 45.6 wt. % and higher density. The "Preferred Diesel Specs" column of Table 3 provides the values corresponding to the preferred properties for the diesel product—a cetane index at least 12 points higher than that of the feed, and a density of no more than 0.860 g/ml at 15.6° C. Other preferred properties not listed in Table 3 include a minimum freeze point of −10° C. and a minimum flash point of 62° C.

Four reactors were used in these Examples. The reactors were packed with catalysts as described in Example 1. Reactors 25 and 35 contained 60 ml each of a commercial NiMo on $\gamma$-$Al_2O_3$ catalyst (TK-607) for pretreatment. Reactors 45 and 55 contained 60 ml each of a commercial NiW on alumina/zeolite catalyst (TK-951) for selective ring opening. Both catalysts are available from Haldor Topsçe, Lyngby, Denmark.

For each of Examples 4-8, catalysts were dried and pre-sulfided as described in Example 1 with the exception that the final temperature during pre-sulfiding was 349° C. for the targeted pretreatment catalyst (TK-607) and 371° C. for the selective ring opening catalyst (TK-951). After pre-sulfiding, the feed was changed to SRD to stabilize the catalyst as described in Example 1 at a constant temperature of 349° C. and at a pressure of 6.9 MPa (69 bar) for 12 hours in an initial pre-coking step. The feed was then switched to the LCO in order to complete pre-coking the catalysts by feeding LCO for at least 6 hours and testing for sulfur until the system has reached steady-state.

LCO feed was pre-heated to 93° C. and pumped to Reactor 25. Certain run conditions (feed rate—LHSV, Reactor temperatures—WABT) are provided in Table 5. Other conditions are as follows. The total hydrogen feed rate was 356 l/l (2000 scf/bbl). Pressure was 13.8 MPa (138 bar). The recycle ratio was 6. The unit was run for 6 hours to achieve steady state.

TLP samples collected at the end of Reactor 55 under steady state conditions were batch distilled to remove the naphtha cut (maximum boiling point of 200° C.) and a diesel cut from the remaining liquid product. Results for Examples 4 through 8 are shown in Table 5.

As seen in Table 5, hydrogen consumption was extremely high, in all the examples exceeding 250 normal liters of $H_2$ per liter of oil, N l/l (1400 scf/bbl). This is surprisingly high compared to consumption rates usually observed in ULSD applications which range 35 to 73 N l/l (200 to 400 scf/bbl) (Parkash, S., Refining Processes Handbook (p. 48) Elsevier, 2003). After reaction, catalysts in Examples 4-8 showed no indications of short-term coking.

Sulfur and nitrogen contents were found to be at preferred levels for a diesel product from this pretreatment/ring-opening process. At the more severe conditions, in Examples 4 and 5 (higher WABT or lower LHSV), the diesel products met the preferred diesel specifications. Density of the feed was reduced by as much as 8.5% and the cetane index increased substantially. Naphtha yield was less than 23% on a weight basis.

The results for Examples 4-8 demonstrate the ability of the combined hydrotreating/ring-opening process in multiple reactors to upgrade LCO to valuable streams with diesel properties acceptable for blending it into the diesel pool in an oil refinery.

TABLE 5

Summary of Examples 4 through 8

| Example | Sample | LHSV $hr^{-1}$ | WABT ° C. | Density$^{15.6°\ C.}$ g/cc | API Gravity | Sulfur wppm | Nitrogen wppm | Cetane Index | Naphtha Yield (wt. %) | $H_2$ Cons. N l/l (scf/bbl) |
|---|---|---|---|---|---|---|---|---|---|---|
| Feed | | | | 0.9409 | 18.7 | 4980 | 671 | 24.6 | | |
| 4 | TLP | 0.7 | 382 | 0.8398 | 36.8 | 10 | 1 | 33.3 | 22.4 | 255 (1433) |
| | Diesel | | | 0.8575 | 33.4 | 9 | <1 | 37.8 | | |
| 5 | TLP | 0.7 | 371 | 0.8560 | 33.6 | 10 | 1 | 37.7 | 14.2 | 291 (1635) |
| | Diesel | | | 0.8673 | 31.5 | 7 | <1 | 36.4 | | |
| 6 | TLP | 0.7 | 360 | 0.8664 | 31.7 | 10 | 1 | 30.5 | 9.5 | 268 (1507) |
| | Diesel | | | 0.8747 | 30.1 | 11 | <1 | 34.4 | | |
| 7 | TLP | 1.0 | 382 | 0.8589 | 33.1 | 8 | 1 | 27.7 | 15.5 | 295 (1656) |
| | Diesel | | | 0.8705 | 30.9 | 8 | <1 | 35.6 | | |
| 8 | TLP | 1.0 | 371 | 0.8670 | 31.5 | 16 | 1 | 30.0 | 10.3 | 287 (1612) |
| | Diesel | | | 0.8752 | 30.0 | 25 | <1 | 32.5 | | |

Examples 9-13

Two LCO feeds from a FCC unit were hydroprocessed in the same pilot unit described in Examples 1-8. The properties of these feeds are provided in Tables 6 and 7. LCO1 was used in Examples 9 and 10 and had very similar properties to the one used in Examples 4 to 8. LCO2 was used in Examples 11-13 and was a slightly lighter feed than LCO1 with about ⅓ of the sulfur and a similar nitrogen content. Total aromatic and polyaromatic content of LCO2 was about 2 wt. % higher than that of LCO1.

TABLE 6

Properties of LCO feeds used in Examples 9 to 13

| Property | Unit | LCO1 | LCO2 | Preferred Diesel Specs |
|---|---|---|---|---|
| Sulfur | wppm | 5200 | 1650 | <50 |
| Nitrogen | wppm | 680 | 650 | |
| Density at 15.6° C. | g/ml | 0.9409 | 0.9341 | 0.860 |
| Density at 20° C. | g/ml | 0.9377 | 0.9309 | |
| API Gravity | g/ml | 18.7 | 19.8 | |
| Refractive Index @ 20° C. | | 1.544 | 1.5413 | |
| Bromine Number | g/100 g | 5.0 | 5.5 | |
| Cetane Index | | 24.6 | 25.7 | Increase >+12 |
| Aromatics | | | | |
| Monoaromatics | wt % | 22.7 | 22.2 | |
| Polyaromatics | wt % | 45.6 | 47.8 | <11% |
| Total Aromatics | wt % | 68.3 | 70 | |

TABLE 7

Boiling Point Distribution of LCO feeds for Examples 9 to 13

| Simulated distillation, wt % | Boiling Point LCO1, ° C. | Boiling Point LCO2, ° C. (° F.) |
|---|---|---|
| Initial Boiling Point (IBP) | 127 | 115 |
| 5% | 210 | 189 |
| 10% | 236 | 227 |
| 20% | 258 | 246 |
| 30% | 270 | 261 |
| 40% | 283 | 269 |
| 50% | 295 | 281 |
| 60% | 309 | 293 |
| 70% | 327 | 308 |
| 80% | 345 | 327 |
| 90% | 361 | 351 |
| 95% | 369 | 366 |
| 99% | 401 | 388 |
| End Point (EP) | 423 | 395 |

The process of Examples 4-8 was repeated using four reactors. Reactors 25 and 35 contained targeted pretreatment catalyst, KF-860, NiMo on alumina support, while Reactors 45 and 55 contained ring-opening catalyst, KC-2610, NiW on zeolite. Both catalysts were obtained from Albemarle Corp., Baton Rouge, La. The catalysts were loaded, dried, sulfided and stabilized with SRD, as described in Example 1.

In Example 9, after pre-sulfiding and stabilizing the catalyst with SRD at a diesel pressure range (6.9 MPa), LCO2 feed was pumped to Reactor 25 using a positive displacement pump at 2.5 ml/minute. Reaction variables for Examples 9-13 are provided in Table 8. Total hydrogen feed rate for these Examples was 382 l/l (2143 scf/bbl). Pressure was 138 bar (13.8 MPa). The unit was run for 5 hours before collecting samples to achieve steady state. For clarity, in the fourth column of Table 8 (WABT), the first number represents the temperature of Reactors 25 and 35, and the second number represents the temperature of reactors 45 and 55.

TABLE 8

Summary of Examples 9 through 13

| Example | Sample | LHSV $hr^{-1}$ | WABT ° C. | RR | Density$^{15.6°\ C.}$ g/cc | API Gravity | Sulfur wppm | Nitrogen wppm | Cetane Index | Naphtha (wt. %) | $H_2$ Cons. N I/I (scf/bbl) |
|---|---|---|---|---|---|---|---|---|---|---|---|
| LCO1 | | | | | 0.9409 | 18.7 | 5200 | 680 | 24.6 | | |
| LCO2 | | | | | 0.9341 | 19.8 | 1650 | 650 | 25.7 | | |
| 9 | TLP | 1.1 | 371/382 | 4.6 | 0.8356 | 37.7 | 8 | <1 | 40.7 | 21 | 344 (1932) |
| | Diesel | | | | 0.8552 | 33.8 | 11 | <1 | 40.4 | | |
| 10 | TLP | 0.9 | 371/382 | 5.7 | 0.8336 | 38.1 | 9 | <1 | 38.5 | 29 | 350 (1963) |
| | Diesel | | | | 0.8520 | 34.4 | 13 | <1 | 40.6 | | |
| 11 | TLP | 1.1 | 371/382 | 7.2 | 0.8488 | 35.0 | 21 | <1 | 39.7 | 19 | 339 (1905) |
| | Diesel | | | | 0.8670 | 31.5 | 25 | <1 | 40.1 | | |
| 12 | TLP | 0.9 | 371/382 | 6.0 | 0.8411 | 36.6 | 19 | <1 | 41.3 | 30 | 349 (1962) |
| | Diesel | | | | 0.8672 | 31.5 | 22 | <1 | 39.7 | | |
| 13 | TLP | 1.1 | 371/382 | 4.8 | 0.8458 | 35.6 | 20 | <1 | 39 | 25 | 352 (1976) |
| | Diesel | | | | 0.8684 | 31.3 | 20 | <1 | 40.1 | | |

Samples were collected under steady state. TLP samples were batch distilled to remove naphtha product (maximum boiling point of 200° C.) from the diesel product. Table 8 provides results for both TLP and diesel products.

Compared to the feed, product samples in Examples 9-13 show significantly reduced density and lower sulfur and nitrogen contents. Hydrogen consumption was over 330 N l/l (1900 scf/bbl). The cetane index increased by more than 12 points in the diesel products of all the samples in Examples 9-13. Monoaromatics and polyaromatics were both less than 31 and 7 wt. %, respectively, for the diesel products of Examples 9-11. Cloud point and flash point in the diesel product for Example 9 were found to be −10° C. and 80° C., respectively. Thus, the targeted pretreatment/selective ring-opening process can be used to upgrade LCO to more valuable products which may be used as blending stock for diesel fuel.

Examples 14-21

LCO2 feed described in Examples 9-13 was treated in the pilot unit described in Example 1.

Reactors 25 and 35 contained targeted pretreatment catalyst, KF-860, while Reactors 45 and 55 contained selective ring-opening catalyst, KC-3210, both catalysts from Albemarle. The catalysts were charged, dried, sulfided and stabilized as described in Example 1

After pre-sulfiding and stabilizing the catalyst, LCO2 feed was pumped to Reactor 25 using a positive displacement pump at 2.5 ml/minute. Salient variables are provided in Table 9. For clarity, in the fourth column of Table 9 (WABT), the first number represents the temperature of Reactors 25 and 35, and the second number represents the temperature of reactors 45 and 55. Total hydrogen feed rate was 325 l/l (1829 scf/bbl). Pressure was 138 bar (13.8 MPa). The pilot unit was maintained at reaction conditions for 5 hours to achieve steady state before collecting any samples.

Results for Examples 14-21 are shown in Table 9. TLP samples were collected and batch distilled to remove the naphtha product (maximum boiling point of 200° C.) from the diesel product. Properties of the diesel product are shown in Table 9. The naphtha product varied from 10 to 15 wt. %.

The results demonstrate the process can be used to upgrade LCO to more valuable streams. As can be seen from Table 9, while sulfur and nitrogen were reduced, density reduction did not achieve the preferred level of 0.860 g/ml and cetane index only moderately increased, suggesting less ring-opening than preferred. The naphtha product, however, was only 10 to 15%. Total hydrogen consumption was 270 l/l (1517 scf/bbl), lower than those achieved in Examples 11-13. Relatively low increase in the cetane index values (compare to the feed) indicate less ring-opening activity. Thus, while improvement in properties of the treated LCO were again observed, choice of the selective ring-opening catalyst impacts the amounts and properties of the naphtha and diesel products. If a modest increase in cetane with a modest decrease in density is acceptable, the ring-opening catalyst used in examples 14-21 would convert 85-90% of the LCO feed into diesel product.

Example 22-25

LCO2 feed used in Examples 9-11 was used here. The pilot unit was the same as described in Example 1. Feed properties are in Tables 6 and 7. The process of Examples 9-13 was repeated using four reactors. Reactors 25 and 35 contained the targeted pretreatment catalyst, KF-860, while Reactors 45 and 55 contained the selective ring-opening catalyst, KC-2710 (NiW on zeolite, 1.5 mm OD cylinders), both from Albemarle. The catalysts were charged, dried, sulfided and stabilized as described in Example 1.

After pre-sulfiding and stabilizing the catalyst, LCO2 feed was pumped to Reactor 1 using a positive displacement pump at 2.5 ml/minute. Variables are provided in Table 10. As in Tables 8 and 9, the fourth column of Table 10, provides the

TABLE 9

Summary of Examples 14 through 21

| Example | Sample | LHSV $hr^{-1}$ | WABT ° C. | RR | Density$^{15.6°\ C.}$ g/ml | Sulfur wppm | Nitrogen wppm | Cetane Index | $H_2$ Cons. N l/l (scf/bbl) |
|---|---|---|---|---|---|---|---|---|---|
| LCO2 | | | | | 0.9341 | 1650 | 650 | 25.7 | |
| 14 | TLP | 1.1 | 366/377 | 4.7 | 0.8696 | 12 | 1 | 31.9 | 295 (1657) |
| | Diesel | | | | 0.8791 | 11 | 1 | 37.6 | |
| 15 | TLP | 1.1 | 371/382 | 4.6 | 0.8671 | 13 | 1 | 31.3 | 288 (1617) |
| | Diesel | | | | 0.8800 | 15 | 1 | 37.4 | |
| 16 | TLP | 1.1 | 377/388 | 4.5 | 0.8642 | 11 | 1 | 28.6 | 281 (1577) |
| | Diesel | | | | 0.8803 | 10 | 1 | 37.4 | |
| 17 | TLP | 0.9 | 371/382 | 5.7 | 0.8656 | 12 | 1 | 34.1 | 289 (1622) |
| 18 | TLP | 1.1 | 377/388 | 4.5 | 0.8654 | 12 | <1 | 31.6 | 290 (1627) |
| 19 | TLP | 1.1 | 382/400 | 4.5 | 0.8639 | 8 | <1 | 26.5 | 270 (1517) |
| 20 | TLP | 0.9 | 382/400 | 5.6 | 0.8654 | 9 | 3 | 26.1 | N/A |
| 21 | TLP | 1.5 | 366/382 | 4.8 | 0.8773 | 20 | 3 | 30.0 | N/A |

temperature of Reactors 25 and 35 (first number), and the temperature of Reactors 45 and 55 (second number). Total hydrogen feed rate was 329 l/l (1851 scf/bbl). Pressure was 138 bar (13.8 MPa). The pilot unit was maintained at reaction conditions for 5 hours to achieve steady state, before collecting any samples.

TABLE 10

Summary of Examples 22 to 25

| Example # | Sample Name | LHSV $hr^{-1}$ | WABT ° C. | RR | Density$^{15.6°\ C.}$ g/ml | API Gravity | Sulfur wppm | Nitrogen wppm | Cetane Index | $H_2$ Cons. N I/I (scf/bbl) |
|---|---|---|---|---|---|---|---|---|---|---|
| LCO2 | | | | | 0.9341 | 19.8 | 1650 | 650 | 25.7 | |
| 22 | TLP | 1.1 | 366/377 | 4.6 | 0.8548 | 33.9 | 20 | <1 | 36.2 | 314 (1760) |
| | Diesel | | | | 0.8999 | 25.6 | 25 | <1 | 34.8 | |
| 23 | TLP | 1.1 | 360/371 | 4.6 | 0.8570 | 33.4 | 11 | <1 | 34.3 | 317 (1780) |
| | Diesel | | | | 0.8874 | 27.8 | 16 | <1 | 37.3 | |
| 24 | TLP | 1.1 | 371/382 | 4.6 | 0.8469 | 35.4 | 11 | <1 | 34.6 | 314 (1760) |
| 25 | TLP | 0.9 | 371/382 | 5.7 | 0.8632 | 32.3 | 13 | <1 | 31 | 325 (1825) |

Results for Examples 22-25 are shown in Table 10. TLP samples were batch distilled to remove the naphtha product cut (maximum boiling point of 200° C.) from the diesel product cut. The naphtha product was higher in the TLP samples of Examples 22-25 (reaching up to 40%) than those obtained in Examples 9-13, suggesting higher selective ring opening activity with KC-2710 catalyst used here than that observed with the KC-2610 catalyst used in Examples 9-13. The naphtha products in the TLP samples of Examples 22-25 were much higher than those obtained in Examples 14-21 (naphtha product of about 10-15%).

These results show that it is possible to obtain a higher reduction in density and a higher increase in the cetane index but that improved performance comes with the increased naphtha production, which lowers the yield of diesel product. Thus, product distribution (of naphtha and diesel products) and product properties can be changed with reaction conditions such as temperature, pressure, the feed flow rate (LSHV), and/or recycle ratio.

Comparative Examples

Comparative Examples were conducted with the targeted pretreatment catalysts only (no selective ring opening catalyst). Comparative Examples illustrate the value and importance of the combined two step process proposed in this invention. Prior to performing the Comparative Examples, it was determined that one stage could only accomplish a small degree of sulfur, nitrogen and aromatic reduction, and that at least two stages of liquid full reactors, as defined herein, were necessary. Two pretreatment stages were used in these Examples.

Comparative Examples A-I

The LCO feed described in Example 4-8 was used. The properties of this feed are provided in Tables 3 and 4.

Reactors 25 and 35 were used in this experiment. Except for the following, reactor conditions are the same as those in Example 4. The reactors were packed with a targeted pretreatment catalyst as described in Example 4. Reactors 25 and 35 contained 60 ml each of a commercial NiMo on $\gamma$-$Al_2O_3$ catalyst (TK-607). The catalyst drying, pre-sulfiding and stabilizing was carried out as described in Example 4. Reaction conditions (feed rate—LHSV, Reactor temperature—WABT, and recycle ratio—RR) are provided in Table 11.

TLP samples and off-gas samples were collected once the reactors reached steady state. As shown in Table 11, different conditions were explored to study the sulfur and nitrogen kinetics as well as to find optimal conditions for targeted pretreatment prior to feeding the pretreated product to the selective ring-opening reaction zone. The maximum nitrogen content that can be tolerated by the ring opening catalyst without deactivation is between about 5 ppm and about 50 wppm. As shown in Table 11, the minimum conditions to meet the nitrogen content were achieved in most of the Comparative Examples A through I. If a process condition which leaves a substantial amount of unreacted organic nitrogen in the product at the outlet of the targeted pretreatment step were to be used for the combined "targeted pretreatment/selective ring-opening" process, the ring-opening catalyst would have been poisoned.

Comparative Examples E-H considered whether increasing the severity of the reaction conditions, i.e., decreasing the LHSV to 1 $hr^{-1}$ and increasing the temperature, would result in meeting the preferred diesel product specifications. At the most severe conditions, (Example E, LHSV of 1.00 $hr^{-1}$ and WABT of 371° C.), density was only reduced to 0.8827 g/ml and the cetane index increased to 30.4, with relatively high hydrogen consumption.

TABLE 11

Summary of Comparative Examples A to I

| Comp. Example | LHSV $hr^{-1}$ | WABT ° C. | RR | Density$^{15.6°\ C.}$ g/ml | API Gravity | Sulfur wppm | Nitrogen wppm | Cetane Index | $H_2$ Cons. N I/I (scf/bbl) |
|---|---|---|---|---|---|---|---|---|---|
| LCO | | | | 0.9446 | 18.2 | 2354 | 836 | 18.4 | |
| A | 1.96 | 338 | 6 | 0.9105 | 23.8 | 216 | 45 | 24.7 | 140 (786) |
| B | 2.03 | 349 | 6 | 0.9056 | 24.6 | 116 | 19 | 25.9 | 163 (917) |
| C | 2.02 | 360 | 6 | 0.8992 | 25.7 | 65 | 6 | 26.8 | 202 (1137) |
| D | 1.99 | 371 | 6 | 0.8992 | 25.7 | 35 | 3 | 27.6 | 226 (1266) |
| E | 1.01 | 371 | 6 | 0.8827 | 28.6 | 8 | <1 | 30.4 | 248 (1394) |
| F | 1.00 | 360 | 6 | 0.8872 | 27.8 | 17 | <1 | 29.7 | 238 (1337) |
| G | 1.02 | 349 | 6 | 0.8949 | 26.5 | 43 | <1 | 28.9 | 199 (1119) |
| H | 1.00 | 338 | 6 | 0.9032 | 25.0 | 98 | 5 | 27.6 | 169 (951) |
| I | 1.99 | 338 | 6 | 0.9135 | 23.2 | 220 | 54 | 26.8 | 135 (757) |

Comparative Examples J to O

LCO feed used in Examples 9-10 was used. The properties of this feed are provided in Tables 6 and 7.

Two reactors were used in this experiment. The reactors were packed with a targeted pretreatment catalyst as described in Example 9. Reactors 25 and 35 contained 60 ml each of a commercial NiMo on $\gamma$-$Al_2O_3$ catalyst (Albemarle KF-860). The catalyst drying, pre-sulfiding and stabilizing was carried out as described in Example 9.

TLP samples and off-gas samples were taken once the reactors reached steady-state. As shown in Table 12, sulfur and nitrogen kinetics were studied by varying the reaction conditions. Conditions for pretreatment prior to feeding the pretreated product to the ring-opening zone section were explored. Again, maximum nitrogen content that can be tolerated by the ring opening catalyst without deactivation is between about 5 ppm and about 50 wppm. As shown in Table 12, minimum conditions to achieve the target nitrogen content were reached in Comparative examples M, N, and O at a LHSV of 1.1 $hr^{-1}$ and a recycle ratio of 4.7. Density of the products under these conditions is not too high relative to the preferred diesel product sulfur specification (0.881 vs 0.860 g/ml).

TABLE 12

Summary of Comparative Examples J to O

| Example | LHSV $hr^{-1}$ | WABT ° C. | RR | Density$^{15.6°\ C.}$ g/ml | API Gravity | Sulfur wppm | Nitrogen wppm | Cetane Index | $H_2$ Cons. N I/I (scf/bbl) |
|---|---|---|---|---|---|---|---|---|---|
| LCO2 | | | | 0.9341 | 19.8 | 1650 | 650 | 25.7 | |
| J | 3.1 | 366 | 4.7 | 0.9232 | 21.6 | 158 | 321 | 27.8 | 61 (345) |
| K | 3.1 | 377 | 4.5 | 0.9112 | 23.6 | 86 | 142 | 29.4 | 98 (549) |
| L | 3.1 | 366 | 4.5 | 0.9109 | 23.7 | 124 | 151 | 29.7 | 97 (546) |
| M | 1.1 | 366 | 4.7 | 0.8808 | 29.0 | 23 | 2 | 35.0 | 262 (1473) |
| N | 1.1 | 377 | 4.7 | 0.8804 | 29.1 | 12 | 3 | 35.1 | 251 (1412) |
| O | 1.1 | 366 | 4.7 | 0.8818 | 28.8 | 18 | 2 | 34.9 | 249 (1399) |

Table 13 compares the differences in select properties for targeted pretreatment only (Comparative Examples A-O) against the combined targeted pretreatment and selective ring-opening (Examples 1-25). Selected Examples were chosen for illustration. Table 13 displays the reaction conditions, the aromatic content, density and cetane index for the diesel products in these select Examples.

The total aromatic reduction in a combined "targeted pretreatment/selective ring-opening" system with a single recycle loop differs from the same system with targeted pretreatment alone. Density reduction is improved when a selective ring-opening catalyst is used after the targeted pretreatment. In addition, both the cetane index and the naphtha yields are higher, when the targeted pretreatment is combined with the selective ring-opening. Density decrease associated with the ring-opening catalyst (see Examples 4 and 5 vs. Example E in Table 13), indicate that selective ring manipulation is occurring for the saturated polyaromatic (naphthenic) compounds formed in the targeted pretreatment stage. Even though the polyaromatic content decreases (compared to the feed), the mono-aromatic content stays the same.

In the case of targeted pretreatment only (Example E), most aromatic saturation appears to form naphthenic hydrocarbons. When a selective ring-opening catalyst is used after the targeted pretreatment, the additional density reduction appears to indicate the opening of the naphthenic rings since the total aromatic content, and relative amounts of mono- and poly-aromatics remain the same (Examples 4 and 5 vs. Example E in Table 13).

Comparison of Examples 9-13 with Comparative Examples M-O show similar behavior. While, the extent of aromatic saturation is lower when the selective ring-opening is combined with the targeted pretreatment, a lower density results when a targeted pretreatment and selective ring-opening catalysts are both used in a single recycle loop (Example 9-13) versus the targeted pretreatment catalyst only (Examples M-O).

Thus, ring manipulation was achieved using a liquid-full reaction system combining the targeted pretreatment and selective ring-opening catalysts in a single recycle loop with improvements in density reduction and increases in cetane index. Such improvements provide a LCO product that can satisfy Euro IV or V diesel demands and can be blended in a diesel pool.

TABLE 13

Comparison of Aromatic Content, Density and Cetane Index for Several Examples

| Example | HT LHSV $hr^{-1}$ | HC LHSV $hr^{-1}$ | WABT ° C. | RR | Mono Arom wt. % | Poly Arom wt. % | Total Arom wt. % | Density$^{15.6°\ C.}$ g/ml | Cetane Index |
|---|---|---|---|---|---|---|---|---|---|
| LCO1 | | | | | 22.7 | 45.6 | 68.3 | 0.9409 | 24.6 |
| LCO2 | | | | | 22.2 | 47.8 | 70 | 0.9341 | 25.7 |
| 4 | 0.7 | 0.7 | 382<br>382 | 6 | 20 | 4.5 | 24.5 | 0.8575 | 37.8 |
| 5 | 0.7 | 0.7 | 371<br>371 | 6 | 19.6 | 4 | 23.6 | 0.8673 | 37.7 |
| E | 1.01 | 0 | 371 | 6 | 20.2 | 3.8 | 24.0 | 0.8827 | 30.4 |
| 9 | 1.1 | 1.67 | 371<br>382 | 4.6 | 25.9 | 5.3 | 31.2 | 0.8552 | 40.4 |
| 10 | 0.9 | 1.33 | 371<br>382 | 5.7 | 28.1 | 6.5 | 34.6 | 0.8520 | 40.6 |
| 11 | 1.1 | 1.67 | 371<br>382 | 7.2 | 30.6 | 7 | 37.6 | 0.8670 | 40.1 |
| M | 1.1 | 0 | 366 | 4.7 | N/A | N/A | N/A | 0.8808 | 35.0 |
| N | 1.1 | 0 | 377 | 4.7 | N/A | N/A | N/A | 0.8804 | 35.1 |

What is claimed is:

1. A process for hydroprocessing a hydrocarbon feed, which comprises (a) contacting a hydrocarbon feed having a density of at least 0.910 g/ml at a temperature of 15.6° C., an end boiling point in the range of from about 375° C. to about 650° C., an API gravity in the range of about 24 to about 0, a sulfur content in the range from 1500 to 25000 wppm, and a nitrogen content of more than 500 wppm, with (i) a diluent and (ii) hydrogen, to produce a feed/diluent/hydrogen mixture, wherein the hydrogen is dissolved in the mixture to provide a liquid feed;

(b) contacting the feed/diluent/hydrogen mixture with a first catalyst in a first treatment zone, to produce a first product effluent;

(c) contacting the first product effluent with a second catalyst in a second treatment zone, to produce a second product effluent; and (d) recycling a portion of the second product effluent as a recycle product stream for use in the diluent in step (a)(i) at a recycle ratio of from about 1 to about 8 without separating ammonia and hydrogen sulfide and remaining hydrogen from said portion of the second product effluent, wherein hydrogen is recycled with the recycle product stream, wherein the first treatment zone comprises at least two stages, wherein the first catalyst is a hydrotreating catalyst and the second catalyst is a ring opening catalyst, the first and second treatment zones are liquid-full reaction zones, and the total amount of hydrogen fed to the process is greater than 100 normal liters of hydrogen per liter of feed, and wherein there is no separation of ammonia, hydrogen sulfide and remaining hydrogen from the first product effluent prior to feeding the first product effluent to the second treatment zone.

2. The process of claim 1 wherein the hydrocarbon feed is a heavy hydrocarbon.

3. The process of claim 1 wherein the hydrocarbon feed is a light cycle oil.

4. The process of claim 1 wherein the total amount of hydrogen fed to the process is 200-530 l/l (1125-3000 scf/bbl).

5. The process of claim 1 wherein the total amount of hydrogen fed to the process is 250-360 l/l (1300-2000 scf/bbl).

6. The process of claim 1 wherein both the first treatment zone and the second treatment zone have a temperature from about 300° C. to about 450° C., pressure from about 3.45 MPa (34.5 bar) to 17.3 MPa (173 bar), and a hydrocarbon feed rate to provide a liquid hourly space velocity (LHSV) of from about 0.1 to about 10 $hr^{-1}$.

7. The process of claim 6 wherein both the first treatment zone and the second treatment zone have a temperature from about 350° C. to about 400° C., pressure from about 6.9 MPa (69 bar) to 13.9 MPa (139 bar), and a hydrocarbon feed rate to provide a liquid hourly space velocity (LHSV) of from about 0.4 to about 4 $hr^{-1}$.

8. The process of claim 1 wherein the diluent comprises an organic liquid selected from the group consisting of light hydrocarbons, light distillates, naphtha, diesel and combinations of two or more thereof.

9. The process of claim 1 wherein the first treatment zone comprises at least two catalyst beds in one reactor, wherein the beds are physically separated by a catalyst-free zone.

10. The process of claim 1 wherein the first treatment zone comprises at least two reactors each reactor containing one catalyst bed and wherein the reactors are separated by a catalyst-free zone.

11. The process of claim 9 or 10 wherein fresh hydrogen is added between the catalyst beds to the catalyst-free zone.

12. The process of claim 9 wherein the reactor comprises both the first treatment zone and the second treatment zone.

13. The process of claim 12 wherein fresh hydrogen is added between the catalyst beds to the catalyst-free zone.

14. The process of claim 13 wherein the feed/diluent/hydrogen mixture and product effluents are fed from bed to bed in a downflow mode.

15. The process of claim 13 wherein the feed/diluent/hydrogen mixture and product effluents are fed from bed to bed in an upflow mode.

16. The process of claim 1 wherein the first catalyst comprises a metal and an oxide support, wherein the metal is selected from the group consisting of nickel and cobalt, and combinations thereof combined with molybdenum and/or tungsten, and the oxide support is selected from the group consisting of alumina, silica, titania, zirconia, kieselguhr, silica-alumina and combinations of two or more thereof.

17. The process of claim 16 wherein the first catalyst support is alumina.

18. The process of claim 1 wherein the second catalyst comprises a metal and an oxide support, wherein the metal is selected from the group consisting of nickel and cobalt, and combinations thereof combined with molybdenum and/or tungsten and the oxide support is a zeolite, amorphous silica, or a combination thereof.

19. The process of claim 1 wherein the first and second catalysts each comprise a metal which is a combination of metals selected from the group consisting of nickel-molybdenum (NiMo), cobalt-molybdenum (CoMo), nickel-tungsten (NiW) and cobalt-tungsten (CoW).

20. The process of claim 1 wherein the first and second catalysts are sulfided.

21. The process of claim 1 wherein liquid portion of the second product effluent comprises less than 50% by weight of naphtha product and at least 50% by weight of diesel product.

22. The process of claim 21 wherein the diesel product has a sulfur content less than 50 wppm and a nitrogen content less than 10 wppm.

23. The process of claim 1 wherein liquid portion of the second product effluent comprises less than 25% by weight of naphtha product and at least 75% by weight of diesel product.

24. The process of claim 21 wherein the diesel product has a cetane index of at least 12 points higher than the hydrocarbon feed.

25. The process of claim 21 wherein the diesel product has a density of about 0.860 g/ml or less at a temperature of 15.6° C., a sulfur content of less than 50 wppm, and a cetane index of at least 12 points higher than the hydrocarbon feed.

26. The process of claim 1 wherein the first product effluent comprises a nitrogen content of no more than 50 wppm.

* * * * *